US006377779B2

(12) United States Patent
Hisakuni

(10) Patent No.: US 6,377,779 B2
(45) Date of Patent: Apr. 23, 2002

(54) IMAGE FORMING APPARATUS WITH A FRICTION COEFFICIENT BETWEEN AN IMAGE BEARING MEMBER AND A CLEANING BLADE BEING MAINTAINED

(75) Inventor: Hisataka Hisakuni, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/819,674

(22) Filed: Mar. 29, 2001

(30) Foreign Application Priority Data

Mar. 31, 2000 (JP) ..... 2000-098606

(51) Int. Cl.[7] ..... G03G 21/00
(52) U.S. Cl. ..... 399/350
(58) Field of Search ..... 399/350, 351, 399/343, 345, 346, 347, 348, 349; 15/256.5, 256.51

(56) References Cited

U.S. PATENT DOCUMENTS 5,168,309 A * 12/1992 Adachi et al. ..... 399/350
6,021,304 A * 2/2000 Sbert et al. ..... 399/350
6,282,400 B1 * 8/2001 Aoki et al. ..... 399/350

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

In an image forming apparatus, it is necessary to improve slide portions of a cleaning blade and an image bearing body which cause chatter vibration phenomenon in order to configure the cleaning blade so as to be durable of long-term use. In order to solve the above issue, an image forming apparatus for forming a toner image on a recording material which includes an image bearing member and a cleaning blade for cleaning the image bearing member, and in which a decreasing ratio of a friction coefficient $\mu$ between the image bearing member and the cleaning blade relative to common logarithms of driving speeds of the image bearing member is maintained 0.03 or lower for prolonging a service life of the cleaning blade.

3 Claims, 4 Drawing Sheets

| DRIVING SPEED V(mm/s) | 1 | 5 | 10 | 20 | 50 | 100 | 200 | 300 |
|---|---|---|---|---|---|---|---|---|
| COMMON LOGARITHM OF SPEED | 0.00 | 0.70 | 1.00 | 1.30 | 1.70 | 2.00 | 2.30 | 2.48 |
| FRICTIONAL FORCE(N) | 0.18 | 0.17 | 0.17 | 0.16 | 0.16 | 0.15 | 0.15 | 0.15 |
| FRICTION COEFFICIENT $\mu$ | 0.35 | 0.34 | 0.33 | 0.32 | 0.31 | 0.30 | 0.29 | 0.29 |

FIG.3

| DRIVING SPEED V(mm/s) | 1 | 5 | 10 | 20 | 50 | 100 | 200 | 300 |
|---|---|---|---|---|---|---|---|---|
| COMMON LOGARITHM OF SPEED | 0.00 | 0.70 | 1.00 | 1.30 | 1.70 | 2.00 | 2.30 | 2.48 |
| FRICTIONAL FORCE(N) | 0.18 | 0.17 | 0.17 | 0.16 | 0.16 | 0.15 | 0.15 | 0.15 |
| FRICTION COEFFICIENT $\mu$ | 0.35 | 0.34 | 0.33 | 0.32 | 0.31 | 0.30 | 0.29 | 0.29 |

FIG.4

| DRIVING SPEED V(mm/s) | 1 | 5 | 10 | 20 | 50 | 100 | 200 | 300 |
|---|---|---|---|---|---|---|---|---|
| COMMON LOGARITHM OF SPEED | 0.00 | 0.70 | 1.00 | 1.30 | 1.70 | 2.00 | 2.30 | 2.48 |
| FRICTIONAL FORCE(N) | 0.23 | 0.22 | 0.21 | 0.20 | 0.20 | 0.20 | 0.19 | 0.19 |
| FRICTION COEFFICIENT $\mu$ | 0.45 | 0.43 | 0.41 | 0.40 | 0.40 | 0.39 | 0.38 | 0.37 |

IMAGE FORMING APPARATUS WITH A FRICTION COEFFICIENT BETWEEN AN IMAGE BEARING MEMBER AND A CLEANING BLADE BEING MAINTAINED

BACKGROUND OF THE INVENTION

1. Field of the Invention

The present invention relates to an image forming apparatus which forms an image on a recording material by using an electrophotography technique, such as an electrostatic copier or a printer or the like.

2. Related Background Art

There have recently been widely accepted into markets composite machines each having all kinds of output terminals such as a copier, a printer and a facsimile. Image forming apparatuses which use electrophotographic processes are widely accepted as such output terminals corresponding to networks and there is mentioned as a great problem a limited number of sheets for which a main body continuously operates normally without maintenance, or the so-called duty cycle. One of causes for shortening the duty cycle is a service life of an image bearing body as an image bearing member, and great problems are posed from an ecological viewpoint to reduce consumables, prolong service lives of the consumables and enhance reliabilities.

Furthermore, conventional analog apparatuses are being switched to digital apparatuses and there is posed a theme to equalize or lower a cost of a main body of a digital apparatus relative to a cost of a main body of an analog apparatus. Though conventional copiers and printers are mainly white-black apparatuses, full-color originals and full-color output files are used rapidly in larger amount in offices. A theme is therefore posed to equalize not only equalize the price of the digital apparatus to that of the analog apparatus as described above but also to equalize a cost of a main body and a running cost of a full-color printer to those of a white-black printer. Accordingly, it is desired to develop a technique which permits epoch-making lowering of a total cost ownership (TCO).

Specifically, the duty cycle, the running cost and the like of an image forming apparatus are largely dependent on a service life of the image bearing body, and a cleaning device which removes residual developer from the image bearing body can be mentioned as an electrophotographic process technique for determining the service life of the image bearing body.

It is difficult for a cleaning device of a known image forming apparatus to transfer all developer (hereinafter referred to as a toner) of a developer image formed on a surface of the image bearing body to a transferring material at a transferring time and the toner inevitably remains in some amount on the image bearing body. Furthermore, powder of the transferring material and the like which are produced from the transferring material which is brought into contact with the image bearing body also adhere to the image bearing body. It is therefore necessary to clean the image bearing body sufficiently after each transferring step by removing the toner and the powder of the transferring material remaining on the image bearing body after transferring (hereinafter referred to collectively as transferring residual toner).

Out of various kinds of cleaning means which have conventionally been proposed, a cleaning blade which is made of an elastic material, such as urethane rubber and configured to remove the transferring residual toner by scratching off the residual toner with an edge brought into contact with an image bearing body has already been widely put to practical use as known well since the cleaning blade is simple in a configuration, inexpensive in cost and excellent in function.

The above described cleaning blade has an edge at an end which is kept in contact with a drum like image bearing body in a direction reverse to a driving rotating direction of the above described image bearing body and scrapes off transferring residual toner produced at a location to transfer a toner image to a transferring material when the transferring residual toner attains to a location of the edge of the cleaning blade. However, the cleaning blade utilizes the elastic material of rubber and does not slide since a friction coefficient is remarkably large between the elastic material of rubber and the image bearing body.

When a powder material having a small particle diameter such as a developer used for en electrophotography image forming apparatus is interposed between the elastic material of rubber and the image bearing body, however, the cleaning blade slides on the image bearing body, thereby realizing stable contact of the cleaning blade with the image bearing body which is being driven. Furthermore, a small amount of the transferring residual toner which is scraped off and stagnant is supplied to the cleaning blade as the image bearing body rotates to interpose the powder material, whereby a frictional force is weakened and the cleaning blade can exhibit stable and favorable cleaning performance without being turned over.

In the cleaning device which has the above described configuration, however, not only the friction coefficient but also friction between the cleaning blade and the image bearing body is unstable, and a tip portion of the cleaning blade which is kept in substantial contact with the image bearing body causes a chatter vibration, thereby producing an abnormal noise from the cleaning device or resulting in insufficient cleaning due to lowering of a capability to remove the residue from the surface of the image bearing body.

In order to solve these problems, there have been adopted means for stabilizing a slide condition by mixing a lubricant with a toner and means for selecting a contact condition where the cleaning blade is hardly loaded. For preventing stick-slip which causes a chatter vibration phenomenon in particular, there have been proposed a configuration to enhance a rigidity of the cleaning blade and a configuration to reduce an elasticity loss.

However, there lies an obstacle to a durability of the cleaning blade since it is necessary to improve slide portions of the cleaning blade and the image bearing body which constitute an original cause for the chatter vibration phenomenon in order to configure the cleaning blade so as to be durable of long-term use and the chatter vibration phenomenon cannot be prevented by means for simply weakening a frictional force.

The stick-slip phenomenon which causes the chatter vibration phenomenon of the cleaning blade is caused roughly by a coefficient of static friction which is larger than a coefficient of kinetic friction. When the cleaning blade is shifted from a condition where the cleaning blade adheres (sticks) to the image bearing body with a strong static frictional force to kinetic friction by driving the image bearing body, for example, a coefficient of friction is reduced and the cleaning blade abruptly slips, and thereby is released from distortion. Accordingly, shearing forces of the cleaning blade and the image bearing body which oppose a frictional force, whereby the cleaning blade is again in the condition adhering the image bearing body. When the stick-slip phenomenon is repeated at a high speed, the cleaning blade is vibrated, thereby posing a problem of chattering or emitting of the abnormal noise.

SUMMARY OF THE INVENTION

The present invention has been achieved in view of the above described problems and has an object to provide an image forming apparatus which is capable of exhibiting stable cleaning performance irrespective of a moving speed of an image bearing body.

Another object of the present invention is to provide an image forming apparatus including: an image bearing member; and a cleaning blade for cleaning said image bearing member, in which a friction coefficient between the image bearing member and the cleaning blade is denoted by $\mu$ a decreasing ratio of the friction coefficient $\mu$ relative to a common logarithm of a moving speed of the image bearing member is 0.03% or lower.

Further objects of the present invention will be apparent upon a reading of the following detailed description in connection with the accompanying drawings.

BRIEF DESCRIPTION OF THE DRAWINGS

FIG. 3 is a table listing measuring results of "frictional forces of a cleaning portion relative to driving speeds of the photosensitive body" in an apparatus according to a first embodiment; and FIG. 4 is a table listing measuring results of "frictional forces of a cleaning section relative to driving speeds of a photosensitive body" in an apparatus according to a second embodiment.

DETAILED DESCRIPTION OF THE PREFERRED EMBODIMENTS (First embodiment)

Figure 1:
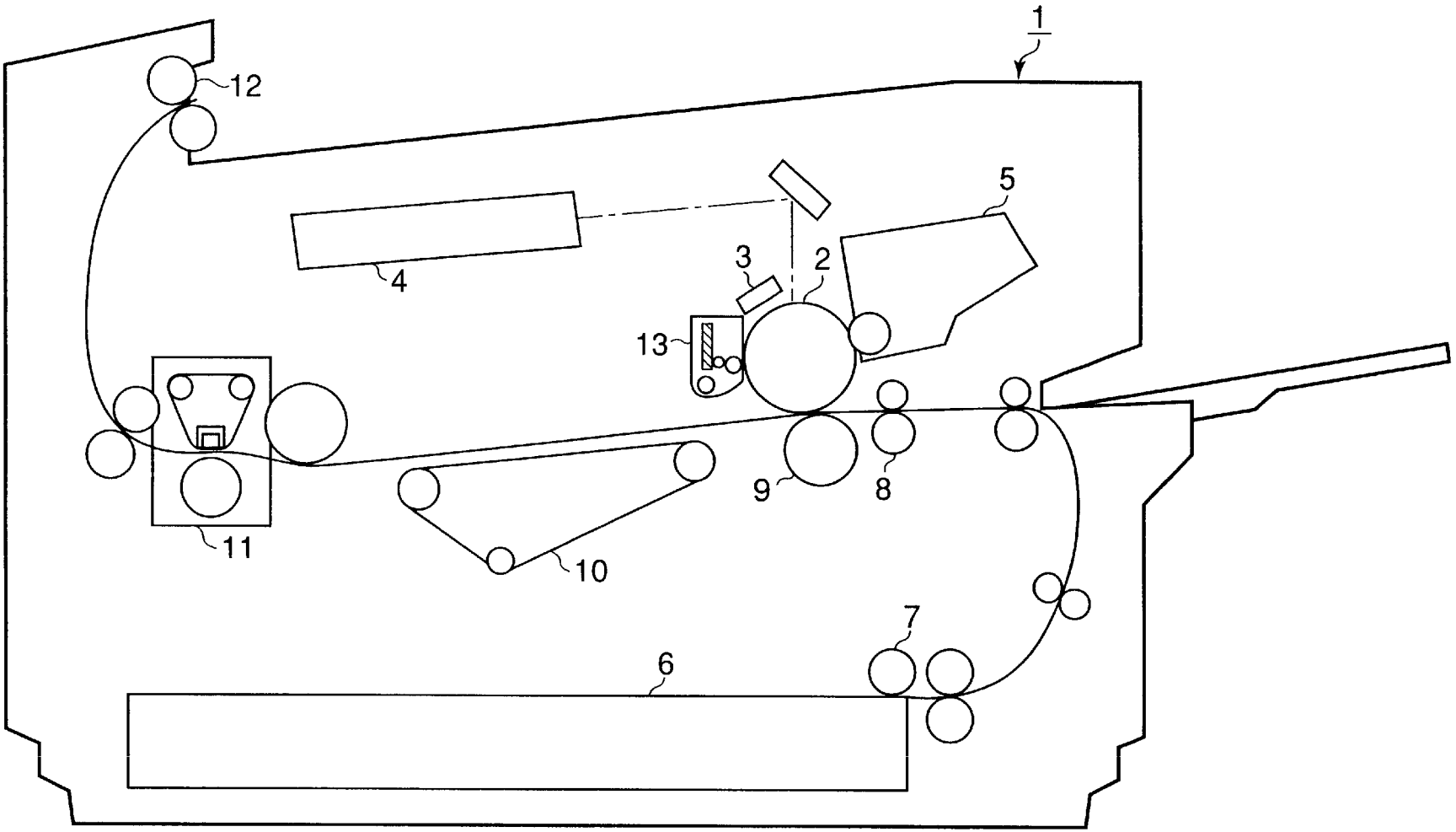
FIG. 1 is a schematic sectional view of an image forming apparatus according to the present invention.
Figure 2:
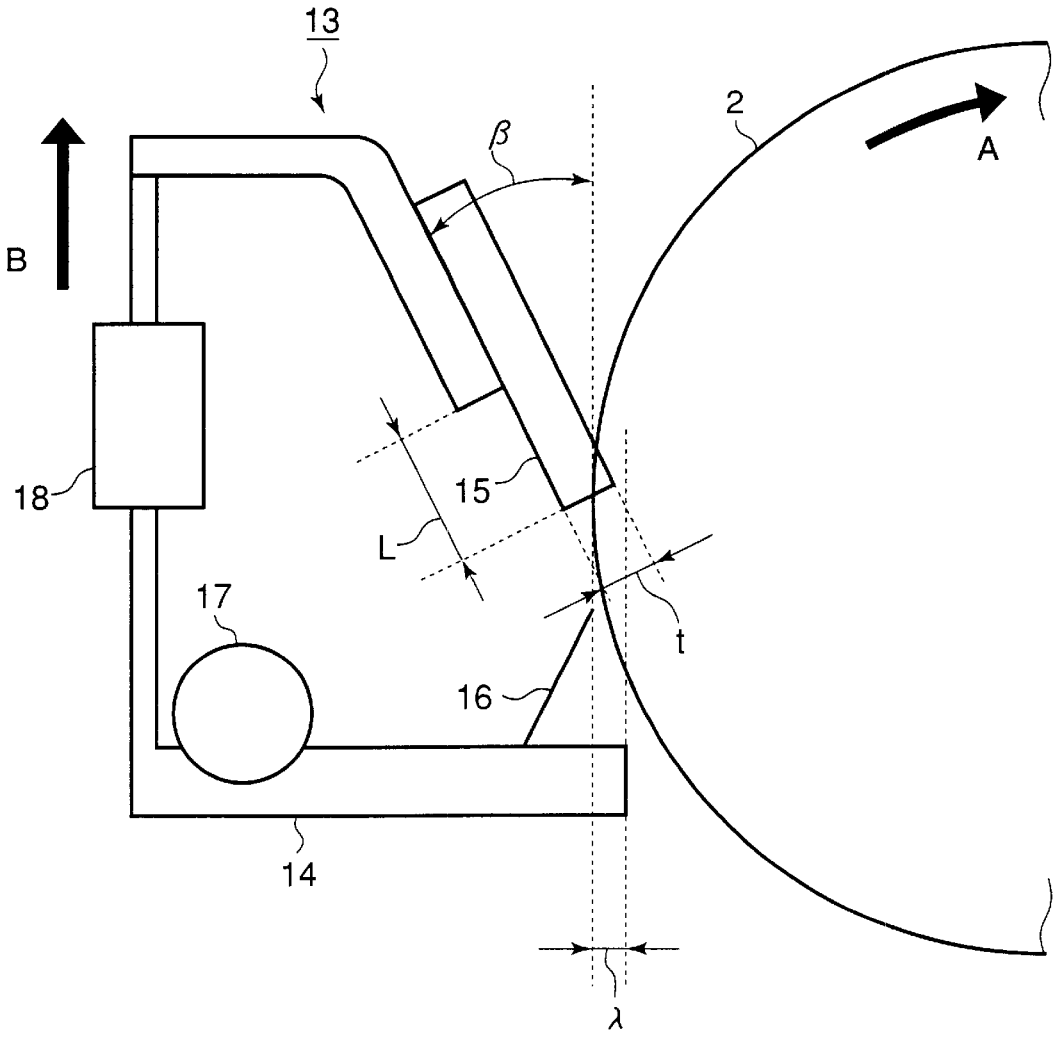
FIG. 2 is a schematic diagram of a device for measuring a frictional force generated between a cleaning blade and a photosensitive body.

A first embodiment of the image forming apparatus according to the present invention will be described using the accompanying drawings. FIG. 1 is an overall configurational diagram of the image forming apparatus, FIG. 2 is a diagram descriptive of a cleaning device and FIG. 3 is a diagram showing measuring results.

(Image forming apparatus)

An image forming apparatus 1 shown in FIG. 1 is an electrophotography type printer which forms an image on a transferring material according to an image signal transmitted from a computer or the like (not shown). The image forming apparatus 1 comprises an image bearing body 2 as an image bearing member. The image bearing body 2 of the image forming apparatus 1 is uniformly charged by charging 3 and a laser transmitter 4 irradiates the image bearing body 2 with rays according to an image signal. An electrostatic latent image is formed on a portion of the image bearing body 2 which is irradiated with the rays and developed with a toner by a developing apparatus 5 into a visualized image.

Sheets are mounted in a cassette 6 are as transferring materials, which are separated and fed one by one with a paper feeding roller pair 7, subjected to correction of skew feeding by a registration roller pair 8 and then brought to the image bearing body 2. A toner image borne by the image bearing body 2 is transferred to the sheet by transferring means 9, sent to fixing means 11 by a conveyer belt 10 and discharged outside the image forming apparatus with an output roller pair 12 after the image is fixed by applying heat and pressure. The toner which remains on the image bearing body 2 after the toner image has been transferred to the sheet is removed with a cleaning device 13 and the image bearing body 2 is used again for image formation.

In the first embodiment, used as the image bearing body 2 was an organic photosensitive body which was coated with a charge generating layer using a titanyl phthalocyanine pigment and a charge transporting layer using bisphenol Z type polycarbonate as a binder.

The toner was prepared by a suspension polymerization method so as to have a configuration of a core containing ester-based wax, a resin layer of styrene butyl acrylate and a surface layer of styrene polyester. Hydrophobic silica and spherical fine particles of silicon resin were added from outside and mixed with the toner.

A form of a powder material is expressed by a form factor SF-1 and a form factor SF-2 which represent a round degree and an irregular degree of a toner particle. Toner images of 0.5 $\mu$m or larger were magnified 1000 times as large by a scanning electron microscope, 100 images were sampled at random, image information was analyzed by way of an interface and values of the factors were calculated by the following formulae:

$$SF-1=\frac{(MXLNG)^2}{AREA}\times\frac{\pi}{4}\times 100$$

$$SF-2=\frac{(PERIME)^2}{AREA}\times\frac{1}{4\pi}\times 100,$$

where

MXLNG: Absolute maximum length

PERIME: Perimeter length of particle

AREA: Projection area of particle

The toner used in the first embodiment had a volumetric average particle diameter of 9 $\mu$m, a form factor SF-1 of 120 and a form factor SF-2 of 105.

Furthermore, spherical fine particles of silicon which was added from outside and mixed had a volumetric average particle diameter of 2.0 $\mu$m, a form factor SF-1 of 115 and a form factor SF-2 of 114. 0.8 part by mass of the hydrophobic silica was added to 100 parts by mass of the toner from outside.

A mixture of the toner to which the hydrophobic silica wad added from outside and a magnetic ferrite carrier was used as a two-component developer. The toner was mixed with the carrier so that the carrier was 0.7% by weight of the toner.

(Cleaning device)

The cleaning device 13 has a casing 14 which has an aperture on a side of the image bearing body 2 and a cleaning blade 15 made of urethane rubber or the like is supported with a supporting member in the above described aperture as shown in FIG. 2. The cleaning blade 15 has an edge which is kept in contact with the image bearing body 2 in a direction reverse to a rotating direction (direction indicated by an arrow A in FIG. 2) of the image bearing body 2, whereby residual toner which could not be transferred by the transferring means 9 is scraped off when the residual toner reaches the edge. Disposed on a bottom of the casing 14 is a scooping sheet 16 to allow the scraped toner to drop down into the casing 14 and prevent the toner from being supplied reversely to the image bearing body 2 in a large amount.

A screw 17 is disposed in the casing 14 as conveying means for discharging the residual toner so that the residual toner dropped into the casing 14 is conveyed in a direction perpendicular to the paper surface and discharged outside the cleaning device 13. The cleaning device 13 which is configured as described above prevent the casing 14 from being clogged by the residual toner.

A setting of the cleaning blade 15 relative to the image bearing body 2 constitutes an important factor which determines cleaning performance. An intrusion depth $\lambda$ as an imaginary intrusion of the cleaning blade 15 into the image bearing body 2, a contact angle $\beta$, free length L, a thickness t of the cleaning blade 15 and the like can be mentioned as setting conditions for bringing the cleaning blade 15 into contact with the image bearing body 2. In order to measure a frictional force between the cleaning blade 15 and the image bearing body 2, a load converter 18 is disposed in a support section of the cleaning blade 15 in the first embodiment to permit measuring a frictional force applied to the cleaning blade 15 in a direction indicated by an arrow B in FIG. 2.

The first embodiment selects an intrusion depth $\lambda$ of 0.5 mm, a contact angle of 30°, a blade thickness of 3 mm and a free length of 5 mm. Furthermore, a variation of a frictional force caused by changing a driving speed can be measured since a driving speed of the image bearing body 2 is changeable. The cleaning blade 15 used in the first embodiment was made of polyurethane rubber, and actual measurements of physical values of the cleaning blade 15 by the test methods for vulcanizates according to JIS indicated A hardness of 73° and a modulus of impact resilience of 50%.

FIG. 3 shows results of frictional forces measured with the image forming apparatus which has the above described configuration. Frictional forces F(N) measured from the load converter 18 were measured at speeds V (peripheral speeds) of the image bearing body 2 while 100 images of an original corresponding to an optical density of image of 5% were formed. Used as a measuring instrument (not shown) was an apparatus manufactured by Shinto Kagaku, Co., Ltd. Furthermore, a force to press the cleaning blade 15 to the image bearing body 2 was set at 0.5 N, and friction coefficients $\mu$ were calculated by a formula shown below using a value of the pressure as a vertical drag N(N) and compared with common logarithms of the speeds V.

$$F=\mu N$$

When decreasing ratios of the friction coefficients $\mu$ relative to the logarithms of the speeds were approximated to a straight line by the least square method, the results shown in FIG. 3 indicated a decreasing ratio of the friction coefficient of 0.026. This is because not only the powder which governs a sliding property between the image bearing body 2 and the cleaning blade 15 but also an additive agent was configured spherical, thereby reducing the friction coefficients and variations of the friction coefficients relative to the speeds.

A durability evaluation test effected by feeding 20000 sheets in the conditions mentioned above indicated that the image bearing body can be cleaned favorably with no chatter vibration phenomenon of the cleaning blade 15, no emission of abnormal noise or no lowering in cleaning performance.

(Comparative example)

In a comparative example, experiments were effected in the same conditions as those in the first embodiment, except for a ground toner which was used in place of the spherical toner. A toner was prepared by melting, mixing and kneading paraffin wax and carbon black using styrene acryl as a binder, finely grinding the mixture with a grinder and classifying the ground mixture with an air classifier. 0.8 part by mass of hydrophobic silica was added to 100 parts by weight of the toner from outside, thereby obtaining the ground toner. As in the first embodiment, a mixture of the toner containing the external additive and the magnetic ferrite was used as a two-component developer. The toner was mixed with the carrier so that the carrier is 0.7% by weight of the toner.

When friction coefficients of the cleaning blade were compared with common logarithms of speeds V of the image bearing body 2 using the developer as in the first embodiment, a friction coefficient decreasing ratio of 0.030 was obtained. During a durability test which was effected while passing a sheet as in the first embodiment, the cleaning blade 15 was vibrated and started to emit an abnormal noise when more than 10000 sheets were fed, and the cleaning blade was broken and could not remove residue from the image bearing body 2, thereby allowing defective images to be formed when 20000 sheets were fed.

(Second embodiment)

Next, a description will be made of a second embodiment of the cleaning device and the image forming apparatus according to the present invention. Measuring results of frictional forces in the second embodiment are shown in FIG. 4, in which items corresponding to those in the first embodiment are denoted by the same reference characters with no description in particular.

Used in the second embodiment were the ground toner mixed with the external additive adopted for the comparative example in combination with an organic photosensitive body which contained particles of a fluoroplastic dispersed in a charge transporting layer using as a binder the bisphenol Z type polycarbonate of the image bearing body 2. This organic photosensitive body was used for enhancing a sliding property of the image bearing body 2 and 30 parts by mass of fine particles of the fluoroplastic were dispersed for 100 parts by mass of the polycarbonate used as the binder. Furthermore, an intrusion depth of the cleaning blade 15 into the image bearing body was set at 1.0 mm. Other items were the same as those in the first embodiment.

The above described configuration is capable of enhancing an abrasion property of the cleaning blade 15 for the image bearing body 2, thereby allowing a sliding property to be enhanced by an abraded powder of the image bearing body 2 itself.

FIG. 4 shows results of friction coefficients of the cleaning blade 15 relative to the image bearing body 2 measured by a method similar to that in the first embodiment. These results provided a decreasing ratio of 0.029 relative to common logarithms of driving speeds V of the image bearing body 2 in the above described configuration.

A durability evaluation test which was effected while feeding 20000 sheets as in the first embodiment indicated that the image bearing body 2 could be cleaned favorably with no chatter vibration phenomenon of the cleaning blade 15, no emission of abnormal noise or no lowering in cleaning performance after feeding 20000 sheets.

The cleaning device and the image forming apparatus according to the present invention are configured so as to allow a decreasing ratio of $\mu$ relative to common logarithms of driving speeds of an image bearing body to be 0.03% or lower when a frictional coefficient of a cleaning blade relative to the image bearing body is denoted by $\mu$ as described above, thereby being capable of preventing a stick-slip phenomenon of the cleaning blade and maintaining favorable cleaning performance for a long time.

Particularly, it is possible to reduce not only friction coefficients between the image bearing body and the cleaning blade but also variations of the friction coefficients relative to speeds when a toner is prepared by adding and mixing spherical fine resin particles to and mix with a spherical toner.

Furthermore, it is possible to enhance an abrasion property of a cleaning blade for a surface of an image bearing body and allow a sliding property to be enhanced by ground powder of the image bearing body itself when an organic photosensitive body which has charge transporting layer made of a binder resin in which particles of a fluoroplastic are dispersed.

The present invention is not limited by the above described embodiments and includes modifications made within a range of a technical concept of the present invention.

What is claimed is:

1. An image forming apparatus for forming a toner image on a recording material, comprising:

an image bearing member; and cleaning blade for cleaning said image bearing member, wherein when a decreasing ratio of a friction coefficient is equal to or lower than 0.03, the friction coefficient between the image bearing member and the cleaning blade being relative to common logarithms of driving speeds of the image bearing member.

2. The image forming apparatus according to claim 1, wherein said apparatus develops a latent image formed on said image bearing member with a spherical toner to which spherical fine resin particles are added from outside.

3. The image forming apparatus according to claim 2, wherein said image bearing member is an organic photosensitive body and a charge transporting layer of said organic photosensitive body is a binder resin in which particles of a fluoroplastic are dispersed.

* * * * *

UNITED STATES PATENT AND TRADEMARK OFFICE

CERTIFICATE OF CORRECTION

PATENT NO. : 6,377,779 B2
DATED : April 23, 2002
INVENTOR(S) : Hisataka Hisakuni It is certified that error appears in the above-identified patent and that said Letters Patent is hereby corrected as shown below:

Column 1,
Line 34, “equalize” (second occurrence) should be deleted.

Column 2,
Line 3, “as” should read -- as is --;
Line 6, “above described” should read -- above-described --;
Line 9, “above described” should read -- above-described --;
Line 18, “en” should read -- an --;
Line 30, “above described” should read -- above-described --; and
Line 55, “for” should read -- of --.

Column 3,
Line 9, “above described” should read -- above-described --; and
Line 65, “are” (second occurrence) should be deleted.

Column 4,
Line 59, “above described” should read -- above-described --.

Column 5,
Line 7, “prevent” should read -- prevents --; and
Line 35, “above described” should read -- above-described --.

Column 6,
Line 45, “above described” should read -- above-described --; and
Line 55, “above described” should read -- above-described --.

Column 7,
Line 18, “above” should read -- above- --.

UNITED STATES PATENT AND TRADEMARK OFFICE

CERTIFICATE OF CORRECTION

PATENT NO. : 6,377,779 B2
DATED : April 23, 2002
INVENTOR(S) : Hisataka Hisakuni It is certified that error appears in the above-identified patent and that said Letters Patent is hereby corrected as shown below:

Column 8,
Line 5, “cleaning blade” should read -- a cleaning blade --; and
Line 9, “being” should read -- is --.

Signed and Sealed this

Second Day of July, 2002

*Attest:*

*Attesting Officer*

JAMES E. ROGAN
*Director of the United States Patent and Trademark Office*